US005502956A

United States Patent [19]

Rompa

[11] Patent Number: 5,502,956

[45] Date of Patent: Apr. 2, 1996

[54] DEVICE FOR PACKAGING PRODUCTS, IN PARTICULAR BREAD, IN BAGS

[75] Inventor: Jozef J. T. Rompa, Oosterhout, Netherlands

[73] Assignee: Quatre Mains B.V., Dongen, Netherlands

[21] Appl. No.: 412,900

[22] Filed: Mar. 29, 1995

[30] Foreign Application Priority Data

Mar. 29, 1994 [NL] Netherlands ..... 9400497

[51] Int. Cl.[6] ..... B65B 43/14

[52] U.S. Cl. ..... 53/572; 53/284.7; 53/260

[58] Field of Search ..... 53/284.7, 572, 53/260, 247, 542

[56] References Cited

U.S. PATENT DOCUMENTS

| | | | |
|---|---|---|---|
| 3,545,175 | 12/1970 | Lillund . | |
| 3,868,807 | 3/1975 | Noyes et al. . | |
| 3,879,918 | 4/1975 | Lerner . | |
| 4,671,048 | 6/1987 | Radenacher | 53/572 |
| 5,327,704 | 6/1994 | Hockzena et al. | 53/570 |

FOREIGN PATENT DOCUMENTS

| | | | |
|---|---|---|---|
| 8700774 | 11/1988 | Netherlands | 53/284.7 |
| 9200716 | 4/1992 | Netherlands . | |

*Primary Examiner*—John Sipos
*Assistant Examiner*—Ed Tolan
*Attorney, Agent, or Firm*—Bell, Seltzer, Park & Gibson

[57] ABSTRACT

A device is described for packaging products, in particular sliced bread, in bags. This device comprises feed and discharge means for the breads to be packaged and a scoop assembly which is principally perpendicular to the direction of conveyance of the products by the device and which can be displaced reciprocally. During operation, the device can bring a bag over the product to be packaged by means of displacement of the scoop assembly, while the product to be packaged is blocked. The scoop assembly comprises an upper and a lower scoop, which scoops can be moved relative to each other. The lower scoop comprises, in order to prevent the crust and/or individual slices of the bread falling over, air flow nozzles which provide a current of air directed obliquely upwards towards the bread.

A scoop assembly is also described which is suitable for use in a packaging device for packaging products in bags.

2 Claims, 1 Drawing Sheet

DEVICE FOR PACKAGING PRODUCTS, IN PARTICULAR BREAD, IN BAGS

BACKGROUND OF THE INVENTION

The present invention relates to a device for packaging products, in particular sliced bread, in bags, at least comprising feed and discharge means for the products to be packaged, a scoop assembly which is principally perpendicular to the direction of conveyance of the products by the device and which can be driven in a reciprocating movement, said scoop assembly comprising a lower and an upper scoop, which scoops can be moved relative to each other, in which the device, during operation, can bring a bag over a product placed on the lower scoop, by means of displacement of the scoop assembly, while said product is blocked.

Such a device is known from the Dutch specification laid open for inspection 9200716, in the name of the Applicant. In the device described therein, the scoop assembly moves perpendicular to the direction of conveyance of the breads to be packaged, in a bag which is held open. As a result of the scoops of the scoop assembly moving apart, the bag is stretched around the scoops. Approximately simultaneously, the bread fed by the feed means is brought onto the portion, located at the rear, of the bearing surface of the lower scoop. As a result of the return movement of the scoop assembly and the simultaneous blocking of the bread by a separate blockade component, the bag is drawn over the bread while the bread remains essentially in the same place. After the bag has been placed over the bread, the bread is discharged by the discharge means.

While the bag is being placed over the bread, and in particular while the scoop assembly is being returned, it appears that, in approximately 1% of the breads, the crust of the bread and, in some cases, also one or more individual slices of bread at the end, fall over. When this happens, the packaging process has to be stopped and the slices of bread which have fallen down are labelled as waste. This concerns the crust and the individual slices of the bread near the end of the scoop; the other end of the bread is blocked by a blockade component. Hitherto, attempts have been made to solve this problem by placing air flow nozzles in the upper scoop, which nozzles blow a flow of air against the bread. Such air flow nozzles in the upper scoop do not, however, appear to be fully effective. A separate slice of bread which is liable to fall over will in most cases not be held by the air flow nozzles in the upper scoop. When a falling crust has reached an angle of more than approximately 20° with respect to an upright slice of bread, the air flow from the air flow nozzles will no longer blow on the outside against the crust of the bread but will blow between the crust and the upright slice of bread, with the result that the crust actually falls over more quickly.

SUMMARY OF THE INVENTION

The present invention aims to overcome the above-mentioned disadvantage. To this end, the present invention provides a device which is characterized in that the lower scoop comprises one or more air flow nozzles which provide a flow of air directed obliquely upwards towards the bread.

When the lower scoop comprises such air flow nozzles, the individual slices of bread at the end will fall over less rapidly. Air flow nozzles which are located in the lower scoop are actually better able to hold crusts and/or individual slices of bread when they fall over. Even if a slice of bread, when falling, has reached an angle of approximately 50° with respect to an upright slice of bread, it is still possible to bring the crust or the slice of bread back into the original position because the flow of air from the air flow nozzles is always directed against the outside of the crust.

Preferably, the one or more air flow nozzles are located principally in the plane extending from the mid transverse plane to the end of the lower scoop.

The problem of individual slices of bread falling over arises only at the end of the bread, near the end of the scoop and therefore the air flow nozzles are preferably located in this plane of the lower scoop.

The present invention also relates to a scoop assembly, suitable for use in a packaging device for packaging products in bags, comprising a lower and an upper scoop, which scoops can be moved relative to each other. This scoop assembly is characterized in that the lower scoop comprises one or more air flow nozzles which produce a flow of air directed obliquely upwards towards the bread.

BRIEF DESCRIPTION OF THE DRAWINGS

The invention will now be described in greater detail on the basis of the appended drawing, in which.

DESCRIPTION OF THE PREFERRED EMBODIMENT

Figure 1:
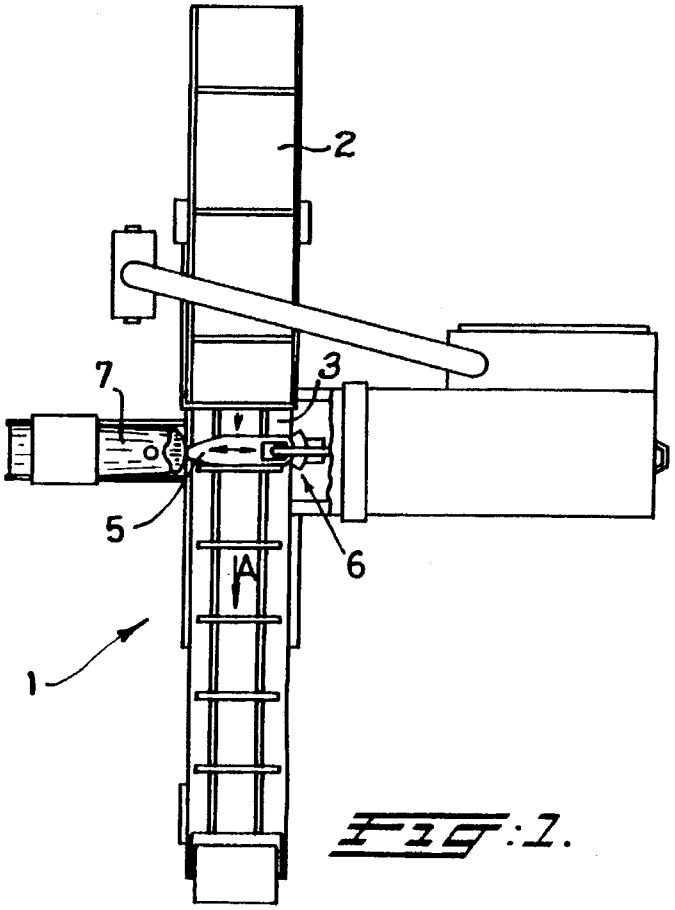
FIG. 1 schematically shows a top view of the device according to the present invention.

FIG. 1 schematically shows a top view of the device for packaging bread in bags according to the invention. The device 1 comprises feed and discharge means in the form of a feed belt 2 and a discharge belt 3. The direction of conveyance of the breads is indicated in the figure with an arrow A. The device also comprises a scoop assembly 6 with a lower scoop 4 and an upper scoop 5. For packaging a sliced bread, the scoop assembly 6, perpendicular to the direction of conveyance of the breads, is moved into a bag 7 which is held open, after which the scoops 4, 5, usually only the upper scoop 5, are moved apart, resulting in the bag 7 being stretched around the scoop assembly. Approximately simultaneously, a bread 8 from the feed belt 2 is brought onto the portion, located at the rear of the bearing surface of the lower scoop 4. While the bread 8 is blocked at one end by a separate blockade component 11 and while the individual slices of bread at the other end are held in the desired position by air flow nozzles 9, located at least in the lower scoop 4, which blow a flow of air in an oblique upward direction against the bread, the bag 7 is then drawn over the bread by a returning movement of the scoop assembly and thereby away from the bottom of the bread 8. After this, the packaged bread is discharged via the conveyor belt 3.

Figure 2:
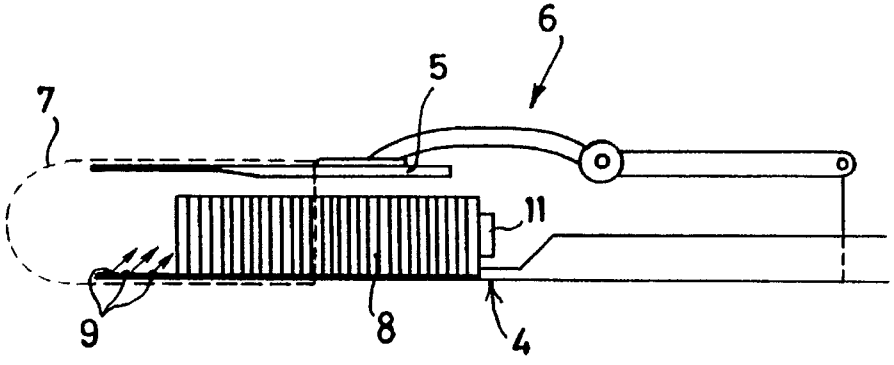
FIG. 2 schematically shows a side view of a scoop assembly according to the invention.
Figure 3:
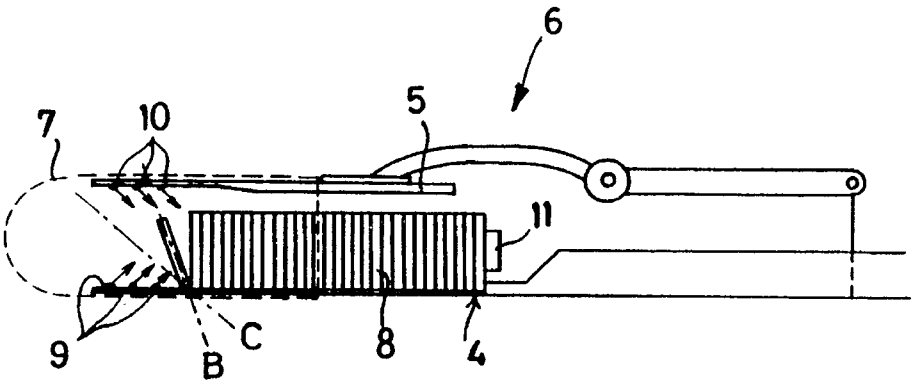
FIG. 3 schematically shows a side view of the scoop assembly according to FIG. 2, in another embodiment.

The air flow nozzles 9 located at least in the lower scoop 4 according to the present invention are further illustrated by FIGS. 2 and 3. FIG. 2 shows an embodiment of a scoop assembly according to the invention in which the lower scoop 4 comprises air flow nozzles 9. When the crust of the bread at the end near the end of the scoop is likely to fall over, this will be prevented by the air flow nozzles 9 in the lower scoop 4 blowing a flow of air obliquely upwards against the bread and thereby holding the bread in the desired arrangement. By adjusting the flow of air according to requirements, the sliced bread can be held in the desired arrangement and, also, a falling slice of bread can be brought back into the original position.

According to the present invention, the air flow nozzles 9 are located at least in the lower scoop 4; it is, however, quite possible for there also to be air flow nozzles 10 present in the upper scoop 5. The fact that blow nozzles in the lower scoop 4 are many times more effective than blow nozzles in the upper scoop 5 is apparent from FIG. 3. In FIG. 3, the discontinuous lines B and C illustrate the cases in which a falling crust of a bread has reached an angle of 20° and 50°, respectively, with respect to the upright bread. Air flow nozzles 10 in the upper scoop 5 will, in case B, be only just capable or incapable of holding the crust, whilst the air flow nozzles 9 in the lower scoop 4, both in case B and in case C, will be able to hold the falling crust.

Although not shown in the figures, the scoops 4, 5 of the scoop assembly 6 according to the present invention are designed to be thick enough for air lines to be able to run through the respective scoops 4, 5, on one side adjoining the blow nozzles 9, 10 countersunk into the scoops and, on the other side, an air supply. There are thus no projecting elements on the scoops 4, 5, so that bringing the bag over the bread 8 and moving the lower scoop 4 away from the bottom of the bread can take place unhindered.

What is claimed is:

1. Device for packaging an essentially horizontal stack of on-edge products in a bag, comprising feed and discharge means for the products to be packaged, a scoop assembly which is essentially perpendicular to the direction of conveyance of the products by said feed and discharge means, said scoop assembly comprising a lower and an upper scoop, means for driving said scoop assembly in a reciprocating movement, means for moving said upper and lower scoops relative to each other, the device, during operation moves said lower and upper scoops in said bag, stretches said bag around said lower and upper scoops, and draws said bag over the products placed on the lower scoop and held by a blocking element holding the downstream end of said products, wherein the lower scoop comprises one or more air flow nozzles which provide a flow of air directed obliquely upwards and upstream towards the products on said scoop.

2. Device according to claim 1, wherein the one or more air flow nozzles are located in the plane extending from the mid transverse plane to the end of the lower scoop.

* * * * *